US006435859B1

(12) United States Patent
Jon

(10) Patent No.: US 6,435,859 B1
(45) Date of Patent: Aug. 20, 2002

(54) FLINT GAS LIGHTER WITH IGNITION RESISTANT MECHANISM

(75) Inventor: Jong-Koo Jon, Inchon (KR)

(73) Assignee: Calico Brands, Inc., Ontario, CA (US)

( * ) Notice: Subject to any disclaimer, the term of this patent is extended or adjusted under 35 U.S.C. 154(b) by 0 days.

(21) Appl. No.: 09/646,018

(22) PCT Filed: Mar. 9, 1999

(86) PCT No.: PCT/US99/05050

§ 371 (c)(1),
(2), (4) Date: Oct. 13, 2000

(87) PCT Pub. No.: WO99/46539

PCT Pub. Date: Sep. 16, 1999

(30) Foreign Application Priority Data

Mar. 11, 1998 (KR) ..... 98-3553

(51) Int. Cl.[7] ..... F23D 11/16; F23Q 2/28
(52) U.S. Cl. ..... 431/153; 431/255
(58) Field of Search ..... 431/153, 255, 431/254, 344, 272, 277

(56) References Cited

U.S. PATENT DOCUMENTS

| | | | | |
|---|---|---|---|---|
| 3,719,447 A | | 3/1973 | Dessoy | |
| 4,784,602 A | | 11/1988 | Nitta | |
| 4,904,180 A | | 2/1990 | Nitta | |
| 5,092,764 A | | 3/1992 | McDonough | |
| 5,145,358 A | | 9/1992 | Shike | |
| 5,165,885 A | | 11/1992 | Iwahori | |
| 5,165,886 A | * | 11/1992 | Frigiere | 431/153 |
| 5,184,948 A | | 2/1993 | Iwahori | |
| 5,228,849 A | | 7/1993 | Frigiere | |
| 5,334,011 A | | 8/1994 | Frigiere | |
| 5,427,522 A | * | 6/1995 | McDonough et al. | 431/255 |
| 5,437,549 A | | 8/1995 | Saito | |
| 5,462,432 A | | 10/1995 | Kim | |
| 5,538,417 A | | 7/1996 | Chan | |
| 5,829,963 A | | 11/1998 | Ichikawa | |
| 5,839,892 A | | 11/1998 | Hwang | |
| 5,997,282 A | | 12/1999 | Man | |
| 6,010,328 A | | 1/2000 | Sung | |
| 6,039,561 A | | 3/2000 | Lei | |
| 6,077,070 A | | 6/2000 | Doucet | |
| 6,095,796 A | * | 8/2000 | Sung | 431/153 |

FOREIGN PATENT DOCUMENTS

| | | |
|---|---|---|
| EP | 0285748 | 10/1988 |
| GB | 870353 | 6/1959 |
| JP | 04174218 | 6/1992 |

* cited by examiner

*Primary Examiner*—James C. Yeung
(74) *Attorney, Agent, or Firm*—Trojan Law Offices

(57) ABSTRACT

A child resistant lighter comprising a standard lighter construction, the improvement comprising an ignition resistance button (B), whereby the ignition resistance button (B) hinders a child's ability to engage the nozzle lever (8) needed to operate the lighter.

6 Claims, 4 Drawing Sheets

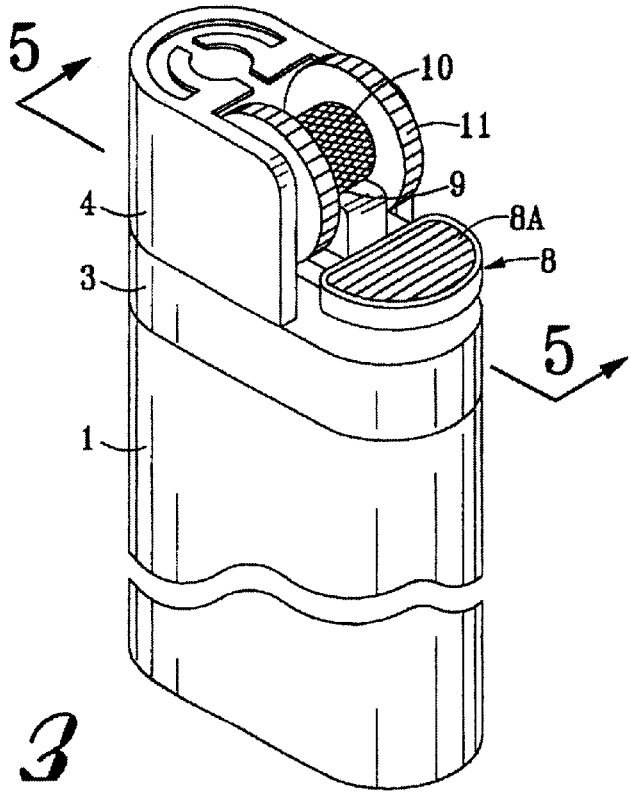
FIG. 4
PRIOR ART
FIG. 3
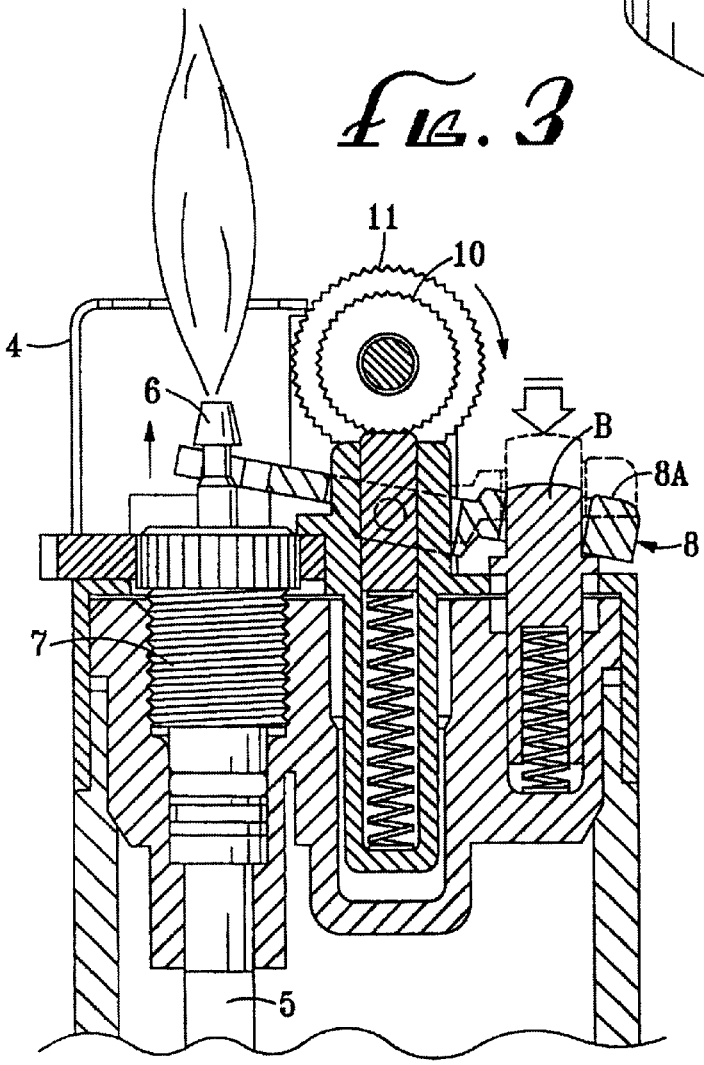

FLINT GAS LIGHTER WITH IGNITION RESISTANT MECHANISM

DESCRIPTION

1. Technical Field

This invention relates to child-resistant lighters.

2. Background Art

The simplicity and ease in operating a standard lighter poses a potential fire hazard when it falls in the hands of children. As an alternative, a number of lighters have been introduced to consumers with various ignition resistance devices to prevent use by children. FIG. 6 is an example of an alternative lighter with an ignition resistance device. The ignition resistance device depicted on FIG. 6 utilizes a protuded ledge, stopper, and compression lever to deter the movement of the nozzle lever. During operation, the compression lever is pushed down pressing the stopper inward causing the protuded lever to be wedged against the nozzle lever and preventing the nozzle lever to move downward. The benefit of using this type of lighter equipped with a compression lever as an ignition-deterrent device is its effectiveness in preventing children's use. The downside, however, is the inconvenience of having to move the compression lever upward each time when a user needs to ignite the lighter. In addition, the complicated structure increases the cost of manufacture.

In an effort to solve the problems above, other types of lighters were introduced that contained ignition resistance devices but were simplier (One Touch) in operation. FIG. 7 illustrates an example of such a One Touch lighter. The One Touch lighter depicted in FIG. 7 utilizes an elastic wheel located on top of the spark wheel and connected to the metal cap. During operation, a user must apply enough force to the elastic wheel to turn the side wheel to create a spark.

The advantage of using a One Touch lighter is that the user can produce an ignition with one-touch operation. However, it is inconvenient to use in the sense that a user has to apply more force to the side wheels than he would with the standard lighter. Furthermore, given that the metal cap and the elastic wheel are positioned at the point where the flame is emitted, there is a potential for the user's thumb and fingers to be burned.

3. Disclosure of Invention

The present invention is a cigarette-lighter with an ignition resistance mechanism. The lighter has an ignition resistance button which must be depressed simultaneously with the release lever which make ignition of the lighter difficult by increasing the requisite amount of force and manual dexterity needed to ignite the lighter. Additionally, the invention adds additional analytical steps to the operation of the lighter to further hinder the ability of small children to use the lighter.

These and other objects and advantages of the present invention will become apparent from the following detailed description of the preferred embodiment of the invention without intending to limit the scope of the invention which is set forth in the appended claims.

BRIEF DESCRIPTION OF DRAWINGS

The advantages of the invention can be more clearly understood by reference to the drawings in which:

FIG. 3 is a profile view of the invention while in use

FIG. 4 is a perspective view of a conventional gas lighter

BEST MODE FOR CARRYING OUT THE INVENTION AND INDUSTRIAL APPLICABILITY

Figure 1:
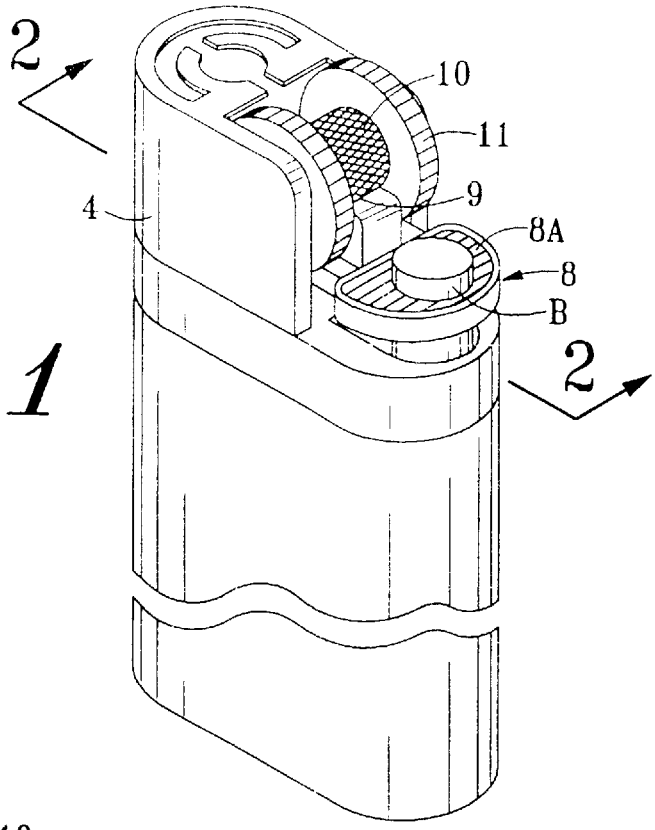
FIG. 1 is a perspective view of the invention
Figure 2:
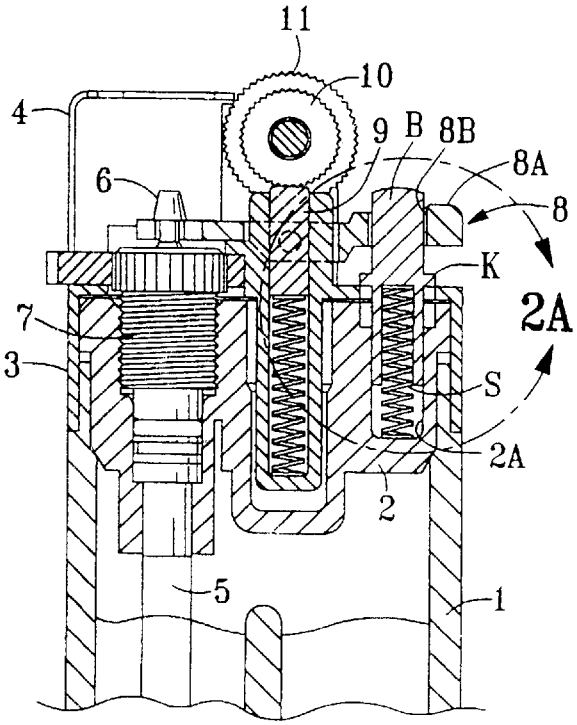
FIG. 2 is a cross-sectional view of the area specified as 2—2 in the FIG. 1
Figure 2A:
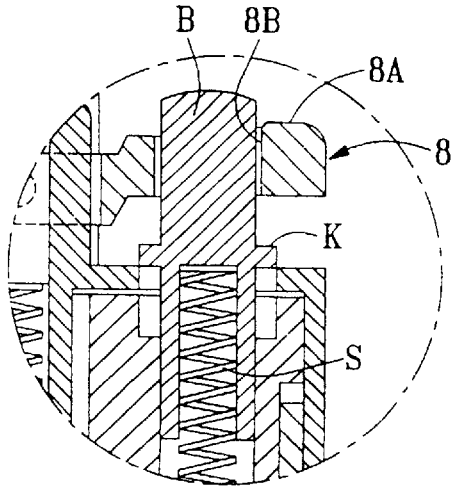
FIG. 2A is a magnified cross-sectional view of the ignition resistance button as specified as area 2A in the FIG. 2
Figure 5:
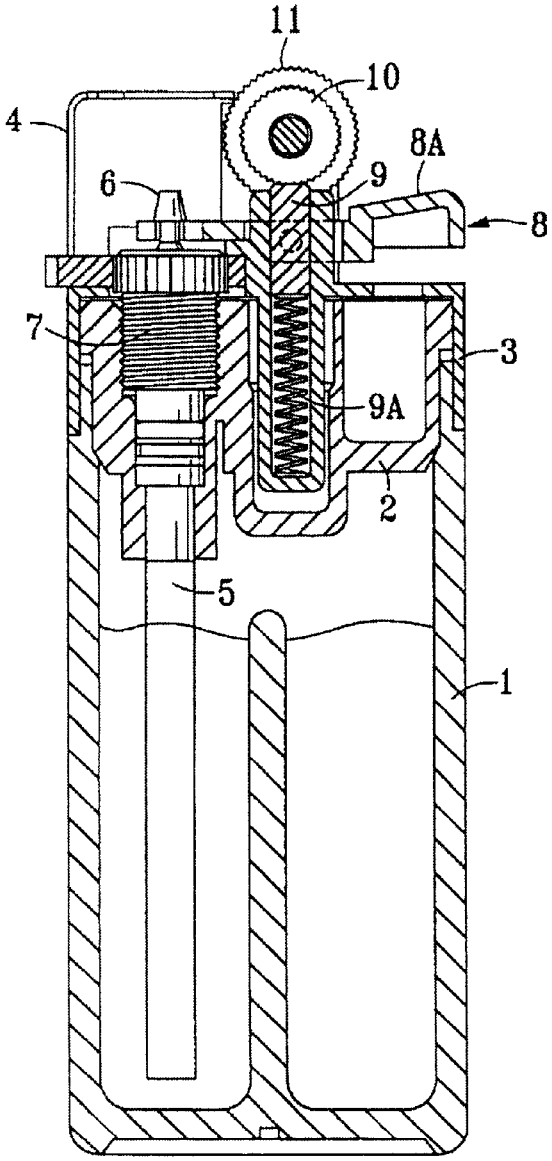
FIG. 5 PRIOR ART
FIG. 5 is a profile view of a conventional gas lighter illustrating the internal mechanical structure
Figure 6:
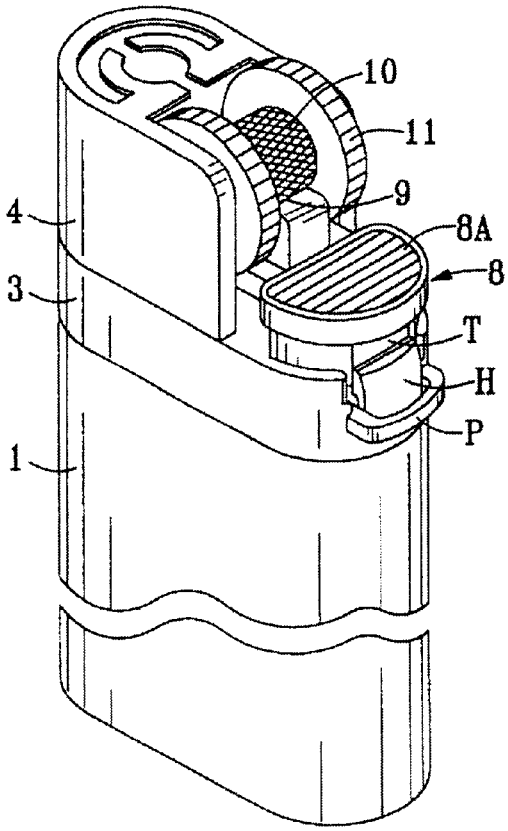
FIG. 6 PRIOR ART
FIG. 6 is a perspective view of a prior art lighter with an ignition resistance device
Figure 7:
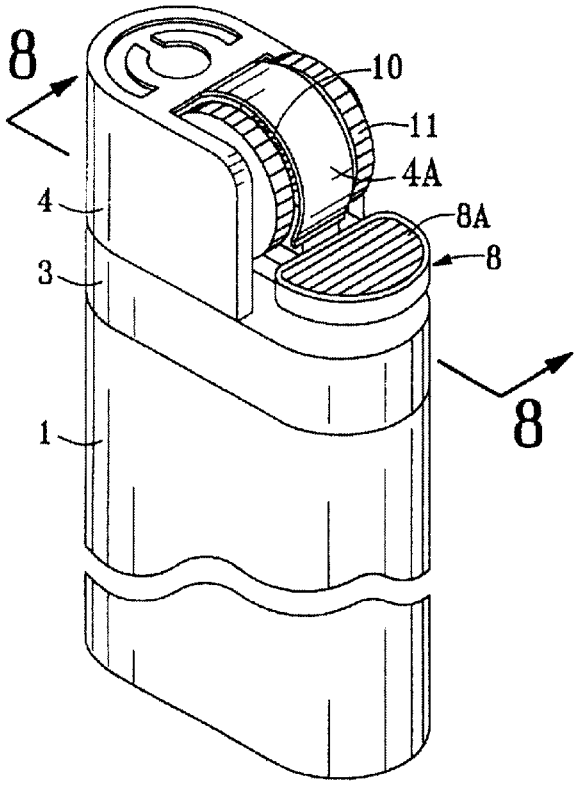
FIG. 7 PRIOR ART
FIG. 7 is a perspective view of a prior art lighter with a one touch ignition resistance device
Figure 8:
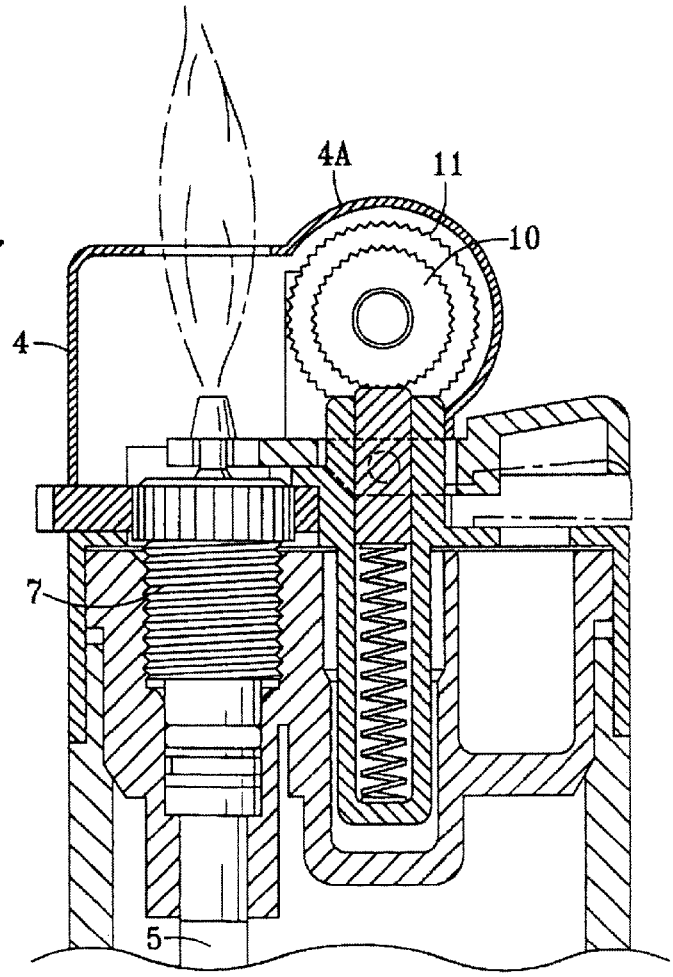
FIG. 8 PRIOR ART
FIG. 8 is a profile view of a prior art lighter with a one touch ignition resistance device illustrating the internal mechanical structure

FIGS. 1 through 3 generally illustrate the present invention, a child resistant lighter, in one of its preferred embodiments. The lighter is constructed of a tank cap (2) connected upward to a gas tank (1) and is securely fastened to the gas tank (2) by a bracket (3). The tank cap (2) includes a gas supply pipe (5) encompassed by the gas tank (1) and attached to the burner assembly (7). A nozzle (6) protudes from the burner assembly (7) and is engaged by a nozzle lever (8) to open and close the nozzle (6). A flint (9) is located within a vacuum area of the tank cap (2) and biased upward by a flint spring (9A). A spark wheel (10) is in contact with the flint (9) and is connected to a side wheel (11). During operation, the user rotates the side wheel (11) with his thumb and simultaneously, depresses the nozzle lever (8) causing the side wheel (11) to rotate the spark wheel (10) against the flint (9) producing sparks which eventually result in ignition with the gas emitted from the nozzle (6) that opens up from the depression of the nozzle lever (8). A metal cap (4) encloses the nozzle (6) and burner assembly (7) to protect the flame.

The new and novel improvement of the present invention includes the addition of an ignition resistance button (B). The ignition resistance button (B) is contained within a vacuum area (2A) and is biased upward by an elastic spring (S) to traverse through the nozzle lever (8). An air way (8B) surrounds the ignition resistance button (B) at the point that the ignition resistance button (B) traverses through the nozzle lever (8) to permit the ignition resistance button (B) to move independent of the nozzle lever (8). During operation, the ignition resistance button (8) is depressed to the finger pad (8A) wherein the ignition resistance button (B) and the nozzle lever (8) are depressed simultaneously to open the nozzle (6) and emitting gas to be ignited.

The lighter is difficult for a young child to operate by increasing the requisite amount of force and manual dexterity needed to ignite the lighter. A child's thumb is not sufficiently strong to depress the ignition resistance button (B) to the finger pad (8A) and thereby prevents engagement of the nozzle lever (8). Moreover, because the nozzle lever (8) is not depressed, the nozzle (6) is not engaged and gas is not released. Additionally, the invention adds additional analytical steps to the process of understanding the operation of the lighter to further hinder the ability of small children to use the lighter.

What is claimed is:

1. A child-resistant lighter having a gas tank (1) for containing a combustible fuel, a gas release means in communication with said gas tank (1), including a burner assembly (7) and a nozzle (6) cooperating with a nozzle release lever (8) for selective actuation between a normally closed nozzle position, which prevents exit of combustible fuel from said gas tank (1), and an open position which permits exit of combustible fuel from said gas tank (1) through said nozzle, said nozzle lever (8) including a finger pad (8A) for actuation of said nozzle lever (8) by a user, a side wheel (11) having a radius and attached to a spark wheel (10) for interacting with a flint (9) biased against said spark wheel (10), the improvement comprising:

an ignition resistance button (B) contained with a vacuum area (2A) and biased upward by spring (S) to traverse through the nozzle release lever (8) and is surrounded by an air way (8B) to permit the ignition resistance button (B) to move independent of the nozzle release lever lever (8).

2. A lighter having a fuel tank connected to a fuel release nozzle, a nozzle release lever normally biased in a closed position, a nozzle lever that engages said nozzle, said nozzle lever including a finger pad for actuation of said lever by a user to open said nozzle, a spark wheel for interacting with a flint biased against said spark wheel, the improvement comprising:

an ignition resistance button biased upward to traverse through said nozzle lever, said ignition resistance button and said nozzle lever capable of moving independently of each other.

3. A lighter having a tank for holding fuel, a fuel release nozzle connected to said tank, a nozzle release lever normally biased in a closed position, a nozzle lever that engages said nozzle, said nozzle lever including a finger pad having a top surface for actuation of said lever to move said nozzle into an open position to release gas, a spark wheel for interacting with a flint biased agaisnt said spark wheel to ignite said gas, the improvement comprising:

an ignition resistance button having a top end, said button biased so that said top end is at a higher elevation than said top surface of said finger pad when said release lever is in a closed position, said ignition resistance button capable of being depressed independently of said nozzle lever whereby said ignition resistance button acts to interfere with depression of said said nozzle lever.

4. The lighter as in claim 3 wherein said button passes through said finger pad.

5. A lighter having a tank for holding fuel, a fuel release nozzle connected to said tank, a nozzle release level normally biased in a closed position, a nozzle lever that engages said nozzle, said nozzle lever including a finger pad having a top surface for actuation of said lever to move said nozzle into an open position to release gas, a spark wheel for interacting with a flint biased against said spark wheel to ignite said gas, the improvement comprising:

an ignition resistance button having a top end, said button biased so that said top end is at a higher elevation than said top surface of said finger pad when said release lever is in a closed position, said top end of said button positioned so as to interfere with depression of said nozzle lever.

6. The lighter as in claim 5 wherein said button passes through said finger pad.

* * * * *